US011346262B2

(12) United States Patent
Okami

(10) Patent No.: US 11,346,262 B2
(45) Date of Patent: May 31, 2022

(54) EXHAUST UNIT

(71) Applicant: FUTABA INDUSTRIAL CO., LTD., Okazaki (JP)

(72) Inventor: Hirohisa Okami, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 697 days.

(21) Appl. No.: 16/244,560

(22) Filed: Jan. 10, 2019

(65) Prior Publication Data

US 2019/0234264 A1 Aug. 1, 2019

(30) Foreign Application Priority Data

Jan. 26, 2018 (JP) ..... JP2018-011573

(51) Int. Cl.
*F01N 1/08* (2006.01)
*F01N 1/16* (2006.01)
(Continued)

(52) U.S. Cl.
CPC ..... *F01N 1/089* (2013.01); *F01N 1/082* (2013.01); *F01N 1/163* (2013.01); *F01N 3/0205* (2013.01);
(Continued)

(58) Field of Classification Search
CPC ..... F01N 1/082; F01N 1/089; F01N 1/163; F01N 3/0205; F01N 3/10; F01N 3/2882;
(Continued)

(56) References Cited

U.S. PATENT DOCUMENTS 5,206,467 A 4/1993 Nagai et al.
5,996,732 A * 12/1999 Burger ..... F01N 1/06 181/230
(Continued)

FOREIGN PATENT DOCUMENTS

JP H04113730 U 10/1992
JP H1130120 A 2/1999
(Continued)

OTHER PUBLICATIONS

Notice of Reasons for Refusal for Japanese Patent Application No. 2018-011573, dated Nov. 12, 2019, 7 pages.
(Continued)

*Primary Examiner* — Audrey B. Walter
(74) *Attorney, Agent, or Firm* — Withrow & Terranova, P.L.L.C.; Vincent K. Gustafson

(57) ABSTRACT

One aspect of the present disclosure provides an exhaust unit including a housing, a wall member, a catalyst, and a muffler chamber. The housing includes a feed inlet and a discharge outlet. The housing is configured such that an exhaust gas of an internal combustion engine is introduced from the feed inlet, and the exhaust gas is discharged from the discharge outlet. The wall member is disposed in the housing, and forms a cylindrical flow path that guides a flow of the exhaust gas introduced from the feed inlet to curve along an outer circumference of an interior of the housing. The catalyst is disposed in the flow path. The muffler chamber communicates with the flow path in a downstream side of the catalyst in the flow path. The wall member serves as a part of a wall that defines an inside and an outside of the muffler chamber.

10 Claims, 3 Drawing Sheets

(51) Int. Cl.

| | |
|---|---|
| ***F01N 3/02*** | (2006.01) |
| ***F01N 3/10*** | (2006.01) |
| ***F01N 3/28*** | (2006.01) |
| ***F01N 13/00*** | (2010.01) |
| ***F01N 13/18*** | (2010.01) |

(52) U.S. Cl.
CPC ..... *F01N 3/10* (2013.01); *F01N 3/2882* (2013.01); *F01N 13/0093* (2014.06); *F01N 13/1866* (2013.01); *F01N 13/1888* (2013.01); *F01N 2230/04* (2013.01); *F01N 2240/02* (2013.01); *F01N 2470/02* (2013.01); *F01N 2490/08* (2013.01); *F01N 2490/155* (2013.01)

(58) Field of Classification Search
CPC ..... F01N 13/0093; F01N 13/1866; F01N 13/1888; F01N 2230/04; F01N 2240/02; F01N 2470/02; F01N 2490/08; F01N 2490/155
See application file for complete search history.

(56) References Cited

U.S. PATENT DOCUMENTS

| | | | | |
|---|---|---|---|---|
| 2003/0173148 | A1* | 9/2003 | Andersson | F01N 1/16 181/272 |
| 2005/0217931 | A1 | 10/2005 | Assad | |
| 2008/0245604 | A1 | 10/2008 | Saunders et al. | |
| 2010/0011752 | A1* | 1/2010 | Edholm | F01N 13/001 60/299 |

FOREIGN PATENT DOCUMENTS

| | | | |
|---|---|---|---|
| JP | 2000130269 | A * | 5/2000 |
| JP | 2006207531 | A | 8/2006 |

OTHER PUBLICATIONS

First Office Action for Chinese Patent Application No. 201910070791.8 dated Sep. 1, 2020, 13 pages including English translation.

* cited by examiner

EXHAUST UNIT

CROSS-REFERENCE TO RELATED APPLICATIONS

The present application claims the benefit of Japanese Patent Application No. 2018-11573 filed on Jan. 26, 2018 with the Japan Patent Office, the entire disclosure of which is incorporated herein by reference.

BACKGROUND

The present disclosure relates to an exhaust unit that allows passage of exhaust gas.

An exhaust unit is proposed by, for example, Japanese Unexamined Patent Application Publication No. 2006-207531 in which a catalyst and a muffler are disposed in a single housing.

SUMMARY

Regarding exhaust units, there is a demand for improving the performance of catalysts, mufflers, and so on, and improving the functionality of the exhaust units in, for example, space saving.

It is preferable that one aspect of the present disclosure provides an exhaust unit with improved functionality.

One aspect of the present disclosure provides an exhaust unit comprising a housing, a wall member, a catalyst, and a muffler chamber. The housing comprises a feed inlet and a discharge outlet. The housing is configured such that an exhaust gas of an internal combustion engine is introduced from the feed inlet, and the exhaust gas is discharged from the discharge outlet. The wall member is disposed in the housing, and forms a cylindrical flow path that guides a flow of the exhaust gas introduced from the feed inlet to curve along an outer circumference of an interior of the housing. The catalyst is disposed in the flow path. The muffler chamber communicates with the flow path in a downstream side of the catalyst in the flow path. The wall member serves as a part of a wall that defines an inside and an outside of the muffler chamber.

Due to this structure, in which the flow path guides the flow of the exhaust gas to curve, the space for the flow path can be reduced as compared to a case in which the flow path is disposed in a straight manner. Moreover, since the muffler chamber abuts the flow path in which the catalyst is disposed, the catalyst can be kept warm due to the exhaust gas in the muffler chamber. Thus, this structure can improve the functionality of the exhaust unit.

In one aspect of the present disclosure, the wall member and an outer wall of the housing may form the flow path.

Due to this structure, the outer wall of the housing is used as a part of the flow path, and thus the number of components in the exhaust unit and the weight of the exhaust unit can be reduced.

In one aspect of the present disclosure, the housing may further comprise a first member, and a second member assembled with the first member. At least one of the first member and the second member may be provided with a slope portion configured such that an interval between the first member and the second member becomes wider toward the catalyst. The exhaust unit may further comprise a plate member disposed between the first member and the second member in a standing manner. The plate member may be in contact with the slope portion and the wall member, be interposed between the first member and the second member, and thereby transmit a pressing force received from the slope portion to the wall member.

Due to this structure, the plate member presses the catalyst through the wall member. This can facilitate the wall member to hold the catalyst and thus restrict the movement of the catalyst within the housing.

In one aspect of the present disclosure, the plate member may serves as partition plates that divide the muffler chamber into multiple chambers.

Due to this structure, the plate member can be also used as a part of the muffler chamber, and thus the number of components in the exhaust unit and the weight of the exhaust unit can be reduced.

In one aspect of the present disclosure, the discharge outlet may be oriented in a direction intersecting with the flow path.

Due to this structure, the following structure can be easily achieved; the exhaust gas is introduced from the feed inlet, flows along the outer circumference of the interior of the housing, and then discharged from the vicinity of the center of the housing, which is away from the outer circumference of the interior of the housing.

In one aspect of the present disclosure, the exhaust unit may further comprise a heat exchanger disposed in the flow path and configured to cool the exhaust gas.

Due to this structure, the volume of the exhaust gas can be first reduced by the heat exchanger, and then the exhaust gas is introduced into the muffler chamber.

In one aspect of the present disclosure, the exhaust unit may further comprise an exhaust gas removal outlet disposed in a downstream side of the heat exchanger in the flow path. The exhaust gas removal outlet may be an exit of the exhaust gas different from the discharge outlet.

Due to this structure, the exhaust gas that has been cooled by passing through the heat exchanger can be taken out from the exhaust gas removal outlet.

In one aspect of the present disclosure, the heat exchanger may be disposed in a portion of the outer circumference of the interior of the housing. The portion is located in a bottom side in a vertical direction when the exhaust unit is used.

In this structure, the heat exchanger is disposed in the bottom side of the housing in the vertical direction. Accordingly, condensation water produced by cooling the exhaust gas can be inhibited from flowing into other parts of the housing.

BRIEF DESCRIPTION OF THE DRAWINGS

An example embodiment of the present disclosure will be described hereinafter by way of example with reference to the accompanying drawings, in which.

DETAILED DESCRIPTION OF THE PREFERRED EMBODIMENTS

[1-1. Structure]

Figure 1:
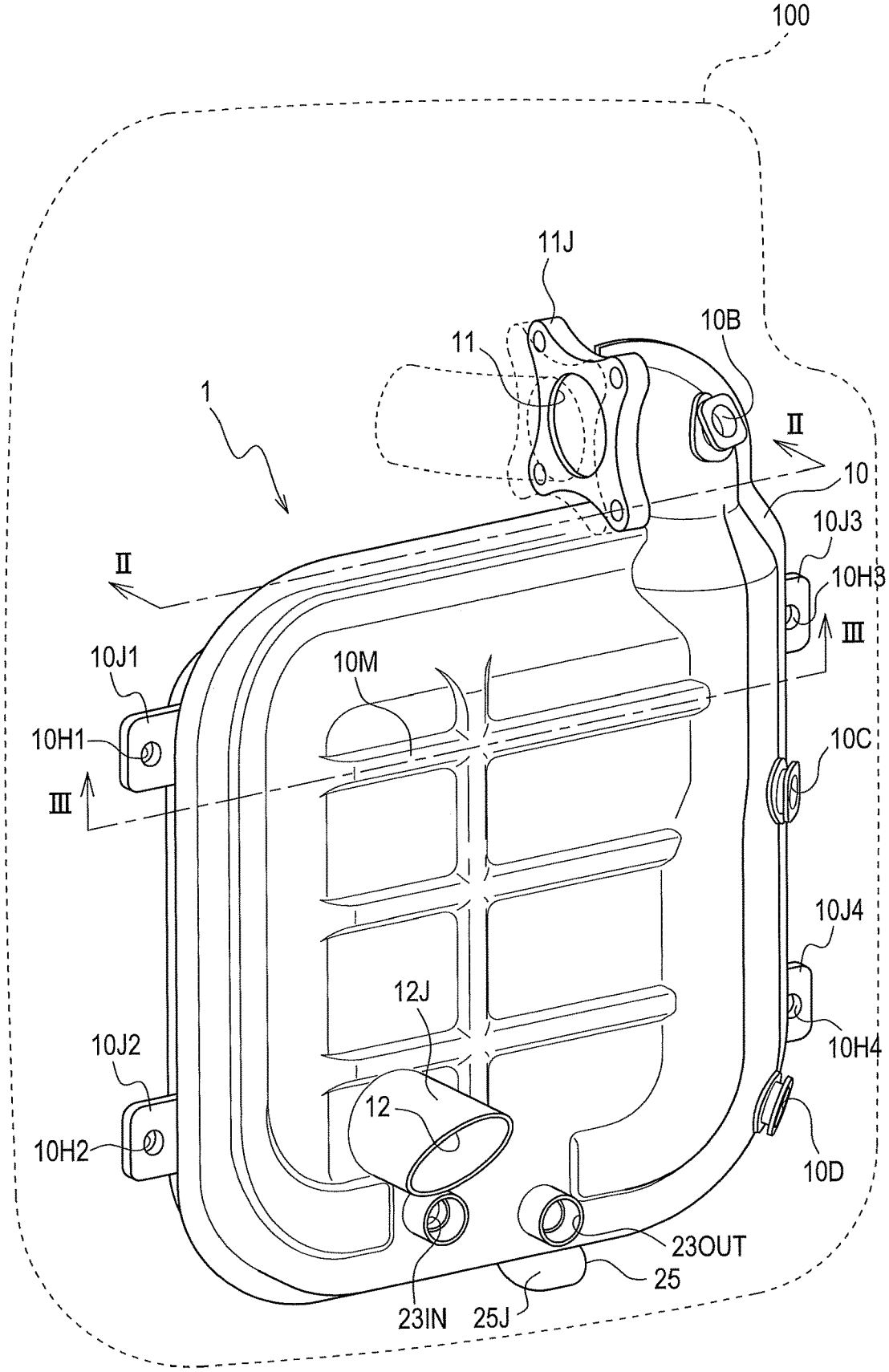
FIG. 1 is a block diagram showing a structure of an exhaust unit.

An exhaust unit 1 shown in FIG. 1 is installed in a vehicle such as a Range Extender Electric Vehicle (REEV). The exhaust unit 1 has a function to purify exhaust gas and to muffle noise while allowing the passage of the exhaust gas.

As shown in FIG. 1, the exhaust unit 1 comprises a housing 10. The housing 10 is configured such that exhaust gas of an internal combustion engine 100 is introduced from a feed inlet 11 and discharged from a discharge outlet 12. The exhaust unit 1 may comprise a first flange 11J, an exhaust pipe connector 12J, a cooling media introducing portion 23IN, a cooling media discharging portion 23OUT, and exhaust gas removal portion 25J. The housing 10 may comprise sensor attachments 10B, 10C, 10D, and second flanges 10J1 to 10J4.

Figure 2:
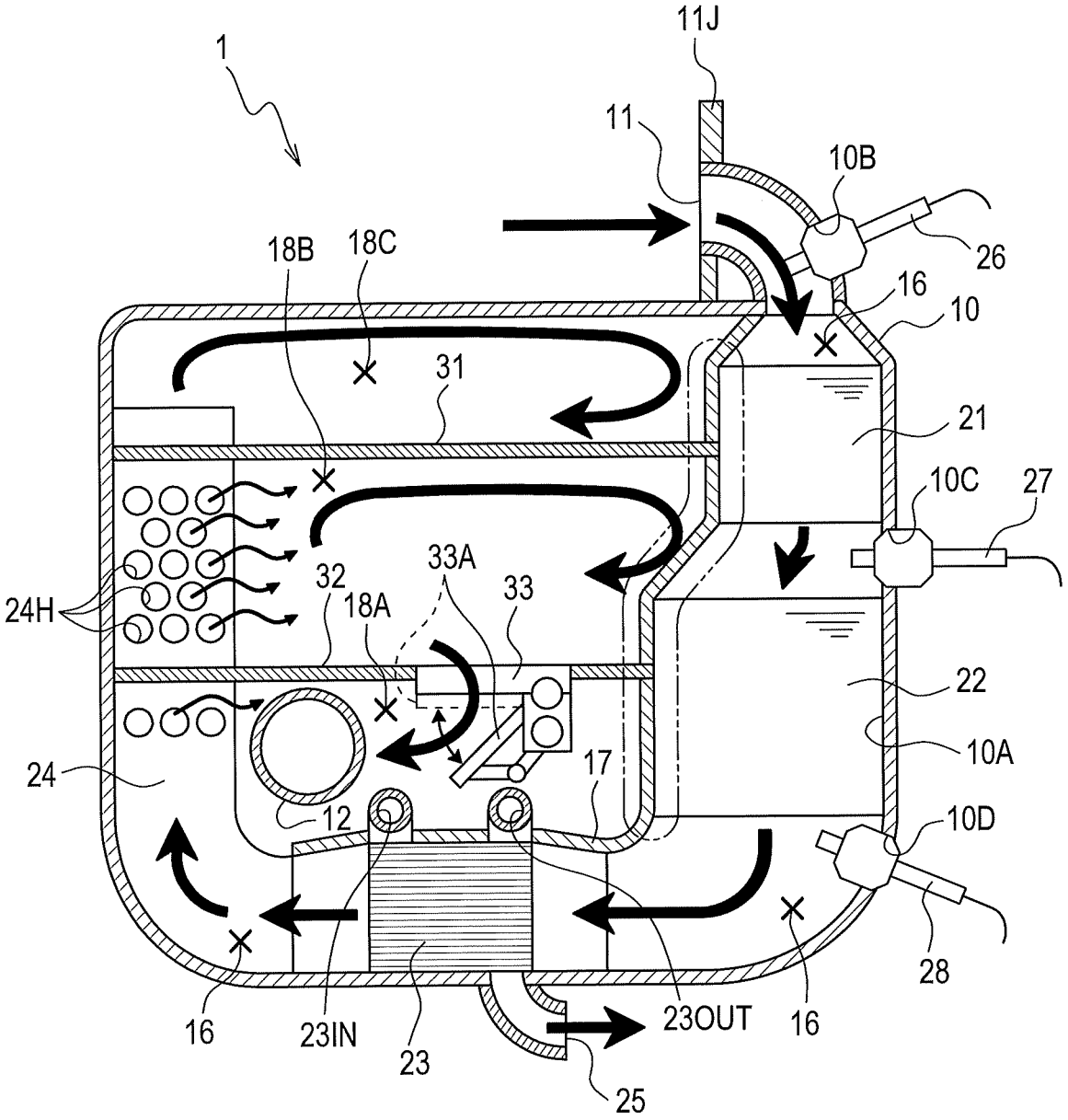
FIG. 2 is a sectional view of the exhaust unit cut along a line II-II in FIG. 1.

As shown in FIG. 2, the sensor attachments 10B, 10C, 10D are provided in the upstream side and the downstream side of catalysts 21, 22 in a flow path 16, which will be described below, so as to communicate the inside and the outside of the housing 10. The upstream side and the downstream side mentioned herein respectively indicate the upstream side and the downstream side relative to the direction of the flow of the exhaust gas.

The sensor attachments 10B, 10C, 10D are portions at which sensors 26, 27, 28 are attached to the housing 10. When the sensors 26, 27, 28 are installed, the sensor attachments 10B, 10C, 10D are sealed. Example of the sensors 26, 27, 28 include oxygen sensors, nitrogen oxide sensors, and temperature sensors.

The second flanges 10J1, 10J2, 10J3, 10J4 secure the housing 10. The second flanges 10J1 to 10J4 are disposed on the perimeter of the housing 10. The second flanges 10J1 to 10J4 may be disposed, for example, on a surface parallel to a surface in which the exhaust gas circulates in the housing 10. The second flanges 10J1 to 10J4 respectively comprise insertion holes 10H1, 10H2, 10H3, 10H4 into which securing members, such as bolts, are inserted. The exhaust unit 1 is attached to the internal combustion engine 100, which serves as an electric generator of the REEV, or on a base where the internal combustion engine 100 is mounted by fitting the securing members inserted in the insertion holes 10H1 to 10H4 to secured portions, such as female screws, provided to the internal combustion engine 100 or the base.

The first flange 11J is provided to couple the feed inlet 11 to another member. Specifically, an exhaust pipe of the internal combustion engine 100 is to be connected to the first flange 11J. In the first flange 11J, the feed inlet 11 is formed for introducing the exhaust gas therefrom. When the first flange 11J is connected to the exhaust pipe, the feed inlet 11 communicates with the exhaust pipe, and the exhaust gas can be introduced from the exhaust pipe to the feed inlet 11.

To the exhaust pipe connector 12J, an exhaust pipe communicating with atmospheric air is to be connected. In the exhaust pipe connector 12J, the discharge outlet 12 is formed through which the exhaust gas that has passed through inside the housing 10 is discharged. The discharge outlet 12 may communicate with atmospheric air through some other device. The discharge outlet 12 is oriented in a direction intersecting with the flow path 16. That is, the discharge outlet 12 is oriented in a direction intersecting with a surface in which the exhaust gas circulates the flow path 16 at a right angle. In the present embodiment, the discharge outlet 12 is oriented in a direction orthogonal to the flow path 16.

To the cooling media introducing portion 23IN, a pipe that guides a flow of a heat exchange media, such as cooling water, is connected. Through this pipe, the heat exchange media is introduced. To the cooling media discharging portion 23OUT, a pipe that guides the flow of the heat exchange media is connected. Through this pipe, the heat exchange media is discharged.

In the exhaust gas removal portion 25J, an exhaust gas removal outlet 25 is formed, and a pipe that guides the flow of the exhaust gas is connected. Through this pipe, a part of the exhaust gas is discharged. The exhaust gas removal outlet 25 is a different outlet from the discharge outlet 12 from which most of the exhaust gas is discharged. The exhaust gas discharged from the exhaust gas removal outlet 25 is used, for example, for Exhaust Gas Recirculation (EGR).

Next, the internal structure of the housing 10 will be described with reference to FIG. 2. As shown in FIG. 2, in the housing 10, a wall member 17 and the catalysts 21, 22 are provided. A heat exchanger 23, an inlet pipe 24, plate members 31, 32, and a valve 33 may also be provided in the housing 10.

The wall member 17 is disposed inside the housing 10 so as to form the cylindrically-shaped flow path 16 that guides the flow of the exhaust gas, introduced from the feed inlet 11, so as to curve along the outer circumference of the interior of the housing 10.

Moreover, in the housing 10, muffler chambers 18A, 18B, 18C are provided in the downstream side in the flow path 16. The muffler chambers 18A, 18B, 18C are provided in a partitioned space created in the housing 10 by the wall member 17, and thus surrounded by the inner surface of the housing 10, the inlet pipe 24, and the wall member 17. The partitioned space is divided into the muffler chambers 18A, 18B, 18C by the plate members 31, 32.

That is, the wall member 17 forms, together with an outer wall 10A of the housing 10, the flow path 16 and forms a part of the muffler chambers 18A, 18B, 18C. The wall member 17 serves as a part of a wall that defines an area where the exhaust gas passes immediately after being introduced from the feed inlet 11 and the muffler chambers 18A, 18B, 18C. The outer wall 10A of the housing 10 forms a part of the flow path 16, and the sensor attachments 10B, 10C, 10D are provided on the outer wall 10A. Accordingly, sensors can be installed in a simple manner as compared to a structure in which additional pipes are provided in the inner side of the outer wall 10A of the housing 10.

In a structure where pipes are provided in the inner side of the outer wall 10A of the housing 10, the difference in thermal stress between the housing 10 and the pipes may cause displacement of the sensor attachments 10B, 10C, 10D. On the other hand, in the structure according to the present embodiment, it is not necessary to concern about such displacement, since the outer wall 10A of the housing 10 is a part of the flow path 16.

The catalysts 21, 22 are disposed in the flow path 16 and have the function of well-known catalysts. In other words, the catalysts 21, 22 have a function to facilitate purification of the exhaust gas, when they are in a specified range of operational temperature. Since the catalysts 21, 22 are disposed adjacent to the muffler chambers 18A, 18B, 18C with the wall member 17 placed between them, the catalysts 21, 22 can be kept warm by the residual heat of the exhaust gas in the muffler chambers 18A, 18B, 18C so as to maintain the operational temperature.

The heat exchanger 23 is disposed in a portion of the outer circumference of the interior of the housing 10 which is located in the bottom side in the vertical direction when the exhaust unit 1 is used. The heat exchanger 23 works as a well-known heat exchanger. That is, the heat exchanger 23 exchanges heat between the exhaust gas flowing in the flow path 16, and the heat exchange media introduced from the cooling media introducing portion 231N and discharged from the cooling media discharging portion 23OUT.

The heat exchanger 23 decreases the temperature of the exhaust gas and thereby reduces the volume and the pressure of the exhaust gas. This facilitates the passage of the exhaust gas through the catalysts 21, 22. Accordingly, as compared to a structure in which the exhaust unit 1 is not provided with the heat exchanger 23 in the housing 10, the exhaust gas in the vicinity of the catalysts 21, 22 can be inhibited from leaking outside the housing 10.

The inlet pipe 24 comprises holes 24H that communicate the inside and the outside of the inlet pipe 24. Through these holes 24H, the exhaust gas flowing in the inlet pipe 24 is supplied to any of the muffler chambers 18A, 18B, 18C. The inlet pipe 24 forms, together with the outer wall 10A of the housing 10, the tubular-shaped flow path 16.

The plate members 31, 32 serve as partition plates that define the muffler chambers 18A, 18B, 18C as partitioned chambers. The plate member 32 disposed closer to the heat exchanger 23 out of the plate members 31, 32 comprises the valve 33 that can change the state of communication between the muffler chambers 18A and 18B.

The muffler chamber 18A functions as an expansion chamber that makes the exhaust gas expanded. The muffler chamber 18C functions as a resonance chamber that resonates exhaust note. The muffler chamber 18B functions as an expansion chamber or a resonance chamber depending on whether the valve 33 is open or closed.

The valve 33 comprises an opening-closing portion 33A. The opening-closing portion 33A is configured to be open when, for example, the pressure of the exhaust gas increases, and to be closed when the pressure of the exhaust gas decreases. Due to this structure, the valve 33 can change the passage of the exhaust gas between: the passage where the exhaust gas is allowed to flow only into the muffler chamber 18A out of the muffler chambers 18A, 18B, 18C; and a passage where the exhaust gas is allowed to flow into the muffler chambers 18A and 18B out of the muffler chambers 18A, 18B, 18C. In other words, the exhaust unit 1 can change the sizes of the expansion chamber and the resonance chamber by the valve 33, and thus can change the frequency of the exhaust note to be muffled.

Figure 3:
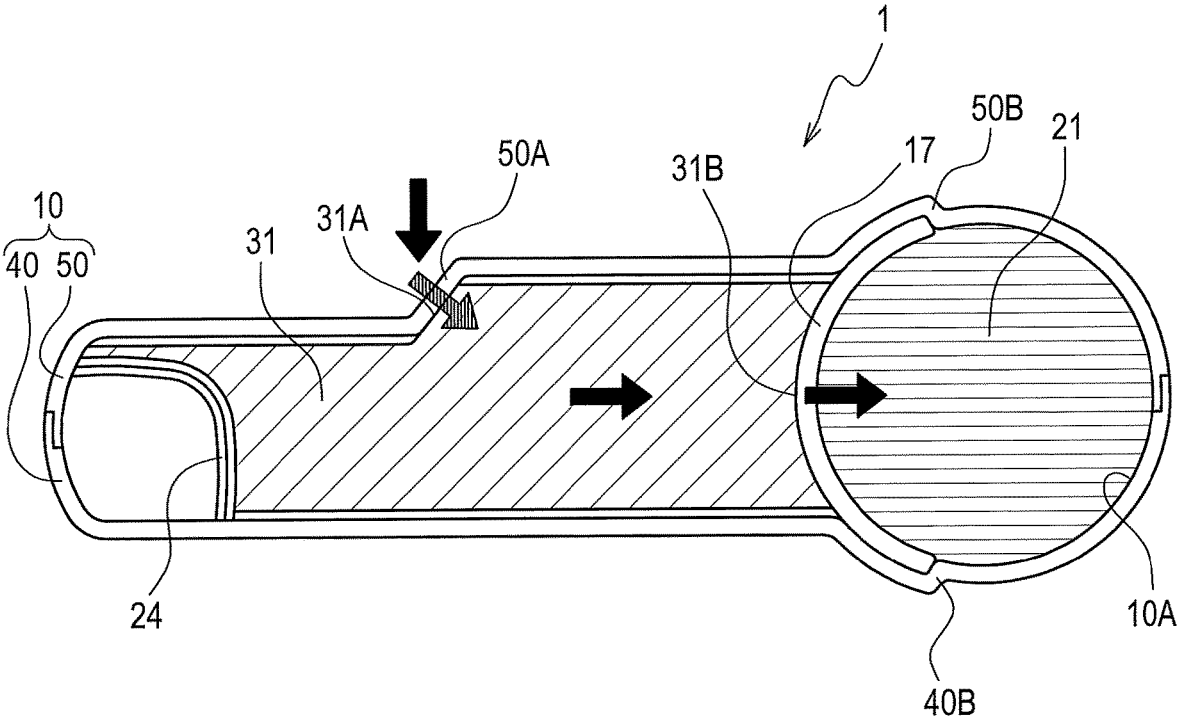
FIG. 3 is a sectional view of the exhaust unit cut along a line in FIG. 1.

As shown in FIG. 3, the housing 10 is formed by assembling a first member 40 and a second member 50. At least one of the first member 40 and the second member 50 comprises a slope portion 50A configured such that the interval between the first member 40 and the second member 50 becomes wider toward the catalysts 21, 22. The second member 50 of the housing 10 comprises a groove portion 10M (see FIG. 1) formed such that the inner side of the second member 50 is grooved so that the groove portion 10M extends outwardly.

The plate member 31, disposed away from the heat exchanger 23, is surrounded by the first member 40, the second member 50, the inlet pipe 24, and the wall member 17 substantially without a gap. The plate member 31 abuts particularly on the slope portion 50A and the wall member 17. The edge of the plate member 31 is engaged with the groove portion 10M, and thereby the movement of the plate member 31 in the vertical direction in FIG. 1 is restricted.

When the first member 40 and the second member 50 are assembled, the plate member 31 is interposed between the first member 40 and the second member 50, and thereby transmits pressing force received from the slope portion 50A to the wall member 17. More specifically, a force in the vertical direction required to assemble the first member 40 and the second member 50 is converted into the pressing force in an oblique direction shown by an arrow with hatching in FIG. 3. Upon receiving the oblique pressing force from the slope portion 50A, the plate member 31 generates a force against the wall member 17 in the horizontal direction along the second member 50. The vertical direction mentioned herein is the up-down direction in FIG. 3, and the horizontal direction is the right-left direction in FIG. 3.

Upon receiving the horizontal force from the plate member 31, the wall member 17 presses the catalyst 21. The first member 40 and the second member 50 respectively comprise stepped portions 40B, 50B around where the lower end and the upper end of the wall member 17 respectively abut the first member 40 and the second member 50. The stepped portions 40B, 50B are configured such that, in the side of the wall member 17, the housing 10 is enlarged from inside approximately by the thickness of the wall member 17.

Moreover, the stepped portions 40B, 50B are configured such that, in the assembling of the first member 40 and the second member 50, a gap is provided between the wall member 17 and the stepped portions 40B, 50B, and, when the wall member 17 receives the horizontal force from the plate member 31, the wall member 17 and the stepped portions 40B, 50B are brought into contact.

In this structure, when the first member 40 and the second member 50 are assembled, the catalysts 21, 22 are interposed between the first member 40 and the second member 50, and thereby receive the vertical force and is held by the first member 40 and the second member 50. Moreover, the catalysts 21, 22 are interposed between the wall member 17 and the outer wall 10A, and thereby receive the horizontal force and is held by the wall member 17 and the outer wall 10A.

[1-2. Effect]

The following effects can be achieved by the embodiment described above in detail.

(1*a*) The exhaust unit 1 according to one aspect of the present disclosure comprises the housing 10, the wall member 17, the catalysts 21, 22, and the muffler chambers 18A, 18B, 18C. The housing 10 is configured such that the exhaust gas of the internal combustion engine 100 is introduced from the feed inlet 11, and the exhaust gas is discharged from the discharge outlet 12. The wall member 17 is disposed in the housing 10, and forms the cylindrical flow path 16 that guides the flow of the exhaust gas introduced from the feed inlet 11 to curve along the outer circumference of the interior of the housing 10.

The catalysts 21, 22 are disposed in the flow path 16. The muffler chambers 18A, 18B, 18C communicate with the flow path 16 in the downstream side of the catalysts 21, 22 in the flow path 16. Moreover, in the muffler chambers 18A, 18B, 18C, the wall member 17 serves as a part of a wall that defines the inside and the outside of the muffler chambers 18A, 18B, 18C.

Due to this structure, in which the flow path 16 guides the flow of the exhaust gas to curve, the space for the flow path 16 can be reduced as compared to a case in which the flow path 16 is disposed in a straight manner. Moreover, since the muffler chambers 18A, 18B, 18C abut the flow path 16 in which the catalysts 21, 22 are disposed, the catalysts 21, 22 can be kept warm due to the exhaust gas in the muffler chambers 18A, 18B, 18C. Thus, this structure can improve the functionality of the exhaust unit 1.

(1*b*) In the exhaust unit 1, the wall member 17 together with the outer wall 10A of the housing 10 form the flow path 16.

Due to this structure, the outer wall 10A of the housing 10 is used as a part of the flow path 16, and thus the number of components in the exhaust unit 1 and the weight of the exhaust unit 1 can be reduced.

(1*c*) In the exhaust unit 1, the housing 10 further comprises the first member 40 and the second member 50. The second member 50 is assembled with the first member 40. At least one of the first member 40 and the second member 50 is provided with the slope portion 50A configured such that the interval between the first member 40 and the second member 50 becomes wider toward the catalysts 21, 22. The exhaust unit 1 further comprises the plate member 31. The plate member 31 is a plate-shaped member disposed between the first member 40 and the second member 50 in a standing manner. The plate member 31 is in contact with the slope portion 50A and the wall member 17, is interposed between the first member 40 and the second member 50, and thereby transmit the pressing force received from the slope portion 50A to the wall member 17.

Due to this structure, the plate member 31 presses the catalysts 21, 22 through the wall member 17. This can facilitate the wall member 17 to hold the catalysts 21, 22, and thus restrict the movement of the catalysts 21, 22 within the housing 10.

(1*d*) In the exhaust unit 1, the plate members 31, 32 serve as partition plates that define the muffler chambers 18A, 18B, 18C as partitioned chambers.

Due to this structure, the plate members 31, 32 can be also used as a part of the muffler chambers 18A, 18B, 18C, and thus the number of components in the exhaust unit 1 and the weight of the exhaust unit 1 can be reduced.

(1*e*) In the exhaust unit 1, the discharge outlet 12 is oriented in a direction orthogonal to the feed inlet 11.

Due to this structure, the following structure can be easily achieved; the exhaust gas is introduced from the feed inlet 11, flows along the outer circumference of the interior of the housing 10, and then discharged from the vicinity of the center of the housing 10, which is away from the outer circumference of the interior of the housing.

(1*f*) The exhaust unit 1 further comprises the heat exchanger 23 disposed in the flow path 16.

Due to this structure, the volume of the exhaust gas can be first reduced by the heat exchanger 23, and then the exhaust gas is introduced into the muffler chambers 18A, 18B, 18C.

(1*g*) In one aspect of the present disclosure, the exhaust unit 1 further comprises the exhaust gas removal outlet 25 disposed in the downstream side of the heat exchanger 23 in the flow path 16. The exhaust gas removal outlet 25 is an exit of the exhaust gas different from the discharge outlet 12.

Due to this structure, the exhaust gas that has been cooled by passing through the heat exchanger 23 can be taken out from the exhaust gas removal outlet 25.

(1*h*) In the exhaust unit 1, the heat exchanger 23 is disposed in a portion of the outer circumference of the interior of the housing 10. The portion is located in the bottom side in the vertical direction when the exhaust unit 1 is used.

In this structure, the heat exchanger 23 is disposed in the bottom side of the housing 10 in the vertical direction. Accordingly, condensation water produced by cooling the exhaust gas can be inhibited from flowing into other parts of the housing 10.

2. Other Embodiments

Although the embodiments of the present disclosure have been explained above, the present disclosure may be achieved in various modifications without being limited to the aforementioned embodiments.

(2*a*) In the aforementioned embodiment, the second member 50 of the housing 10 is provided with the slope portion 50A. The slope portion 50A may be provided to at least one of the first member 40 and the second member 50.

(2*b*) In the aforementioned embodiment, the slope portion 50A is provided with a straight surface so that the cross-section of the slope portion 50A becomes a linear slope. However, the slope portion 50 is only required to be formed such that a portion of the slope portion 50 in contact with the plate member 31 is sloped relative to the direction of assembling the first member 40 and the second member 50. Accordingly, the slope portion 50 may be, for example, provided with a curved surface so that the cross-section of the slope portion 50 is curved like, for example, a circular arc.

(2*c*) The aforementioned embodiment has described a structure in which the plate member 31 out of the plate members 31, 32 holds the catalyst 21 through the wall member 17. The other plate member, namely the plate member 32, may be formed in the same manner as the plate member 31 so that the plate member 32 holds the catalyst 22 through the wall member 17. In this case, a slope portion may be provided to a portion of at least one of the first member 40 and the second member 50 located where that member is in contact with the plate member 32. This structure can achieve approximately the same effect as that achieved by the aforementioned embodiment.

(2*d*) Although the housing 10 is provided with the heat exchanger 23 in the aforementioned embodiment, a structure without the heat exchanger 23 is also possible. Moreover, the housing 10 is provided with two catalysts 21, 22 in the aforementioned embodiment. However, the number of the catalyst may be one, three, or more.

(2*e*) Functions of a single component in the above-described embodiments may be achieved by several components; a single function of a single component may be achieved by several components. Functions of several components may be achieved by a single component; a single function achieved by several components may be achieved by a single component. A part of the configuration of the above-described embodiments may be omitted. At least a part of the configuration of the above-described embodiments may be added to or replaced with another part of configuration of the aforementioned embodiments. All modes encompassed in the technical idea defined by the language described in the claims are embodiments of the present disclosure.

What is claimed is:

1. An exhaust unit comprising:

a housing comprising:

a feed inlet; and a discharge outlet, the housing being configured such that an exhaust gas of an internal combustion engine is introduced from the feed inlet, and the exhaust gas is discharged from the discharge outlet;

a wall member disposed in the housing, and forms a cylindrical flow path that guides a flow of the exhaust gas introduced from the feed inlet to curve along an outer circumference of an interior of the housing;

a catalyst disposed in the flow path; and a muffler chamber communicating with the flow path in a downstream side of the catalyst in the flow path, wherein the wall member serves as a part of a wall that defines an inside and an outside of the muffler chamber; and wherein the housing further comprises:

a first member;

a second member assembled with the first member;

a slope portion provided to at least one of the first member and the second member, the slope portion being configured such that an interval between the first member and the second member becomes wider toward the catalyst; and a plate member disposed between the first member and the second member in a standing manner, the plate member being in contact with the slope portion and the wall member, being interposed between the first member and the second member, and thereby transmitting a pressing force received from the slope portion to the wall member.

2. The exhaust unit according to claim 1, wherein the wall member and an outer wall of the housing form the flow path.

3. The exhaust unit according to claim 1, wherein the plate member serves as partition plates that divide the muffler chamber into multiple chambers.

4. The exhaust unit according to claim 1, wherein the discharge outlet is oriented in a direction intersecting with the flow path.

5. The exhaust unit according to claim 1, further comprising a heat exchanger disposed in the flow path and configured to cool the exhaust gas.

6. The exhaust unit according to claim 5, further comprising an exhaust gas removal outlet disposed in a downstream side of the heat exchanger in the flow path, the exhaust gas removal outlet being an exit of the exhaust gas different from the discharge outlet.

7. The exhaust unit according to claim 5, wherein the heat exchanger is disposed in a portion of the outer circumference of the interior of the housing, the portion being located in a bottom side in a vertical direction when the exhaust unit is used.

8. An exhaust unit comprising:

a housing comprising:

a feed inlet; and a discharge outlet, the housing being configured such that an exhaust gas of an internal combustion engine is introduced from the feed inlet, and the exhaust gas is discharged from the discharge outlet;

a wall member disposed in the housing, wherein the wall member and an outer wall of the housing form a cylindrical flow path that guides a flow of the exhaust gas introduced from the feed inlet to curve along an outer circumference of an interior of the housing;

a catalyst disposed in the flow path;

a muffler chamber communicating with the flow path in a downstream side of the catalyst in the flow path;

a heat exchanger disposed in the flow path and configured to cool the exhaust gas; and an exhaust gas removal outlet disposed in a downstream side of the heat exchanger in the flow path, the exhaust gas removal outlet being an exit of the exhaust gas different from the discharge outlet, wherein the wall member serves as a part of a wall that defines an inside and an outside of the muffler chamber.

9. The exhaust unit according to claim 8, wherein the discharge outlet is oriented in a direction intersecting with the flow path.

10. The exhaust unit according to claim 8, wherein the heat exchanger is disposed in a portion of the outer circumference of the interior of the housing, the portion being located in a bottom side in a vertical direction when the exhaust unit is used.

* * * * *